United States Patent [19]

Igarashi

[11] 4,456,387

[45] Jun. 26, 1984

[54] ELECTRONIC ALARM WRIST WATCH

[76] Inventor: Kazunobu Igarashi, 18-12, Nisisugamo 3-Chome, Tosimaku, Tokyo, Japan, 170

[21] Appl. No.: 201,799

[22] Filed: Oct. 29, 1980

Related U.S. Application Data

[63] Continuation-in-part of Ser. No. 73,129, Sep. 6, 1979, abandoned.

[30] Foreign Application Priority Data

Dec. 18, 1978 [JP] Japan ..... 53-158191

[51] Int. Cl.[3] ..... G04B 19/06

[52] U.S. Cl. ..... 368/230

[58] Field of Search ..... 368/72, 73, 243-245, 368/250-251, 255, 230

[56] References Cited

FOREIGN PATENT DOCUMENTS 51-3326 8/1976 Japan .

*Primary Examiner*—Vit W. Miska

*Attorney, Agent, or Firm*—Browdy and Neimark

[57] ABSTRACT

A silent alarm wrist watch is disclosed wherein the human wrist is vibrated directly by a vibration means at a preset alarm time. The vibration means are energized by an electric signal at a composite frequency made up of two or more frequencies (repetition rates), each selected from a range, one higher, one lower, and both in the range of 0 to 300 Hz. The invention permits low energy consumption of the electric power source in the watch, and effective recognition of the alarm vibration.

9 Claims, 3 Drawing Figures

ELECTRONIC ALARM WRIST WATCH

REFERENCE TO RELATED APPLICATIONS

This application is a continuation-in-part of patent application Ser. No. 73,129 filed on Sept. 6, 1979, now abandoned.

BACKGROUND OF THE INVENTION

1. Field of the Invention

The present invention relates to an electronic alarm wrist watch and particularly to a silent alarm wrist watch adapted to provide an alarm by means of an intermittent vibration applied directly to the human wrist.

2. Description of the Prior Art

There have hitherto been proposed various types of electronic alarm wrist watches. The conventional electronic alarm wrist watch consists of a time standard signal oscillator, counter means for counting the output SECOND time pulses from a frequency divider, display means for displaying the time to which the alarm is set and/or present time, preset means for presetting the alarm time and an electric buzzer for producing an acoustic sound at the preset time.

Ordinarily, the wrist watch is made small in size, and it is difficult to mount therein a large battery which has a large current handling capacity and thus to produce a large acoustic sound. This feature is inconvenient for a person who is working in a noisy area such as an airport, construction work area and so on. For a person who is working at a hospital, theater, a council chamber etc., where the noise is also limited, it is very inconvenient to use an acoustic sound electronic alarm wrist watch.

SUMMARY OF THE INVENTION

Accordingly, an object of the present invention is to construct and arrange a silent alarm wrist watch so that the alarm is provided in the form of vibration instead of the conventional acoustic buzzer.

Another object of the present invention is to provide an alarm wrist watch of the character which has in low electric energy consumption and effective alarming characteristics.

A further object of the present invention is to provide an electronic alarm wrist watch which is usable both in a noisy area and in an area where silence is preferred.

Another object of the present invention is to construct and arrange a silent alarm wrist watch wherein only the owner of the watch can recognize the alarm signaling the arrival of the preset time.

Other objects, features and advantages of the invention will become apparent from the following description taken in conjunction with the attached drawings.

DESCRIPTION OF THE PREFERRED EMBODIMENT

Figure 1:
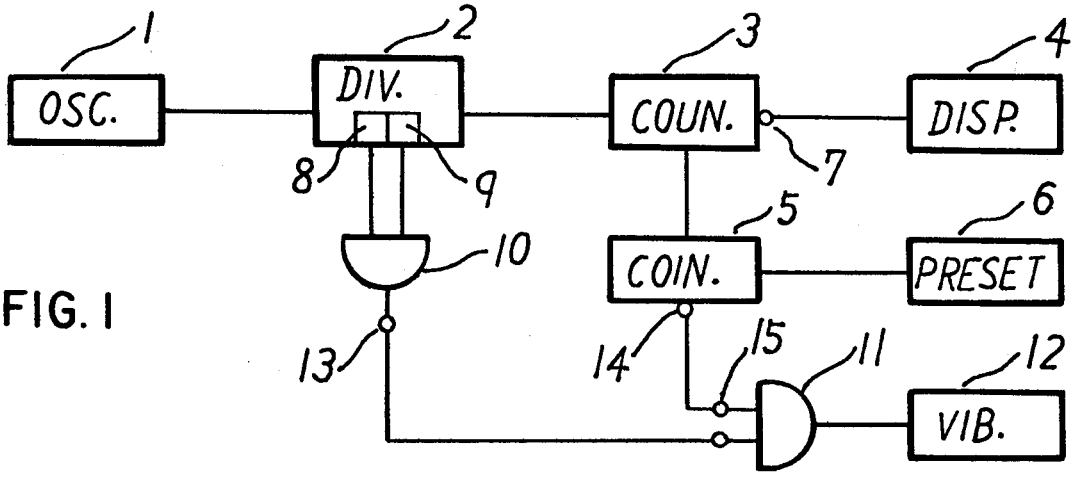
FIG. 1 is a block diagram showing an electronic alarm wrist watch of the present invention.

A description will hereinafter be given on one embodiment of this invention with reference to FIGS. 1 to 3 in which the high frequency (repitition rate) time standard signal produced from an oscillator 1 is divided down to a SECOND time standard signal by means of a frequency divider 2. The SECOND time standard signal is then fed to a counter 3 in which the SECOND time standard signal is counted and a MINUTE and HOUR signal are produced at the output terminal 7 of the counter 3. The output signal from the output terminal 7 is then fed to a display means 4 and the present time is displayed.

When the present time and an alarm time which has been set by a preset means 6 are the same, a coincidence signal is produced at an output terminal 14 of a coincidence circuit 5. The coincidence signal is then fed to an input terminal 15 of the first AND gate 11. The other input terminal of the first AND gate 11 is connected to an output terminal 13 of a second AND gate 10. The input terminals of the second AND gate 10 are connected to a higher frequency (repetition rate) stage 8 and a lower frequency (repetition rate) stage 9 of the frequency divider 2 for producing a synthesized frequency (repetition rate) alarm signal 13*a* in FIG. 2 at the output terminal 13 of the AND gate 10. The frequency of the higher frequency stage 8 and the lower frequency stage 9 shown in FIG. 2, 8*a* and 9*a* are selected from a frequency range 0 to 300 Hz for producing a synthesized frequency signal which is applied to a vibrator 12 to vibrate intermittently the human wrist effectively. The higher frequency stage 8 supplies preferably a signal having a frequency (repetition rate) in the range of from 30 Hz to 300 Hz. The lower frequency stage 9 supplies preferably a signal having a frequency (repetition rate) in the range of from 5 Hz to 50 Hz. The higher frequency stage 8 most preferably supplies a signal of about 100 Hz, it having been found that humans are especially able to sense silent signals at this frequency. They are also more sensitive to signals in the 30 Hz to 300 Hz range generally, when compared with lower and higher ranges. By mixing the high and low frequency (repetition rate) signals, the sensitivity is especially good, a user cannot easily "tune out" such a signal; whereas, when a single frequency is used, it is quite easy for a person to condition himself not to sense the signal.

Figure 2:
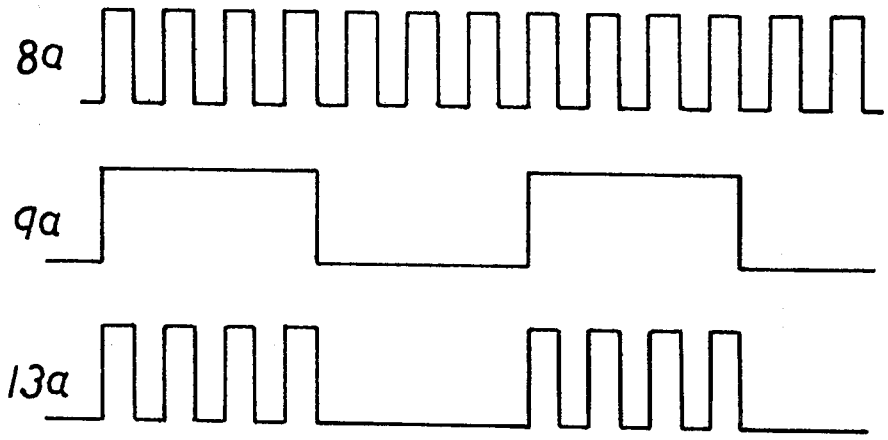
FIG. 2 shows waveforms for causing an effective intermittent vibration.
Figure 3:
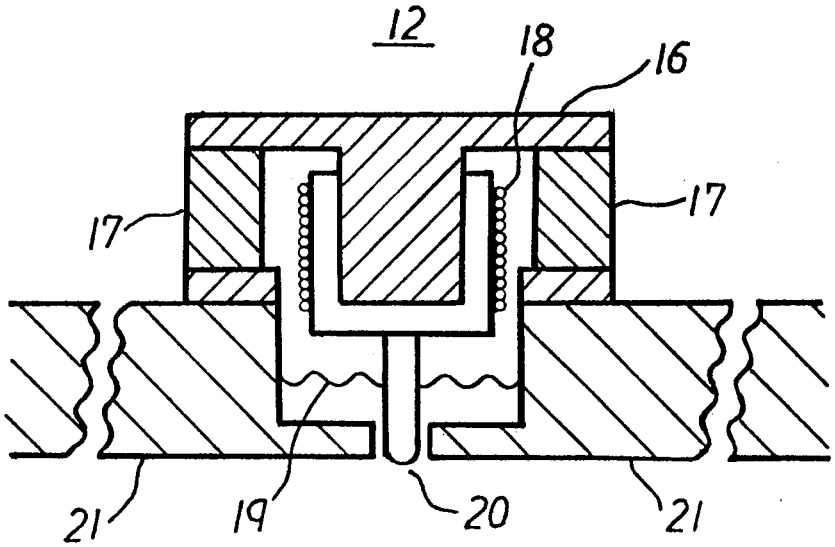
FIG. 3 is a cross-sectional view of a vibrator of the present invention.

The wave shape of the synthesized frequency signal 13*a* in FIG. 2 is not limited to a square wave but may as well be a sine wave, saw tooth wave and other wave shapes to effectively vibrate the human wrist. However, it will be necessary to provide a special oscillator for applying a signal whose wave shape is not square because only a square wave is used in all of the conventional electronic watches. The vibrator 12 shown in FIG. 3 is constructed to cause a vibration efficiently through an assembly including a magnet 17, a yoke 16 and a damper 19 for suspending a vibrating means 20 and a voice coil 18 against one wall of a watch case 21. Other vibrator constructions such as a plunger type, magnetic type and other types could be used for effective vibration instead of the above described vibrator 12.

The most effective vibration is obtained when the resonant frequency of the vibrator 12 and the higher frequency of the synthesized signal 13*a* in FIG. 2 are the same.

When an alarm time arrives and an exciting current is applied to the voice coil 18, the voice coil 18 and the vibrating means 20 start to vibrate the human wrist in contact with the vibrating means 20.

As described above, the vibrator 12 is energized by a synthesized frequency signal selected from 0 to 300 Hz so that it is easy to recognise an alarm as a vibration to the human wrist.

It is possible to cause an alarm vibration continuously or intermittently at the preset time or to cause the vibration together with an acoustic alarm sound.

While a preferred embodiment of the present invention has been illustrated in detail, it will be apparent that many many modifications and variations may be effected without departing from the scope of the novel concepts of this invention.

What is claimed is:

1. A silent electronic alarm for a wrist watch, said silent alarm comprising an output member adapted to vibrate against a user's wrist, the combination comprising:

(a) generator means for generating a high frequency time standard signal;

(b) frequency divider means responsive to the time standard signal for dividing the high frequency time standard to produce low frequency signals, said frequency divider means including means for producing at least two respective signals having a first repetition rate in the range of from substantially 30 Hz to substantially 300 Hz and a second repetition rate in the range of from substantially 5 Hz to substantially 50 Hz, the first rate being greater than the second rate;

(c) counter means responsive to the output of said divider means for producing a signal representative of the present time;

(d) present time display means responsive to said present time signal produced by said counter means to display the present time;

(e) manually settable means for providing a signal representative ofonly one selected time at which it is desired to create an alarm signal comprising said vibration of said output member against said user's wrist;

(f) coincidence means, responsive to output signals from said counter means and said manual alarm time settable means, for producing an alarm enabling signal only upon coincidence of the signals representing the present time and the manually set alarm time; and (g) vibration means, including said output member, responsive to the respective signals having the first and the second repetition rates and the alarm enabling signal, for causing said output member to vibrate against a portion of a user's wrist at the first repetition rate and at the second repetition rate intermittently when the alarm enabling signal is present;

whereby the present time is constantly available in a conventional manner on said present time display means and the manually set alarm time is silently communicated to the user only upon its occurrence in real time by said vibrating means operating at said first and second repetition rates.

2. A silent electronic alarm wrist watch according to claim 1, wherein said display means is operatively arranged to also display the alarm time.

3. A silent electronic alarm wrist watch according to claim 1, wherein said display means is operatively arranged to display both the given alarm time and the present time.

4. A silent electronic alarm wrist watch according to claim 1, including electronic power supply means for providing power to circuits of the watch.

5. A silent electric alarm wrist watch according to claim 1, wherein said means responsive to the respective signals having the first and second repetition rates and the alarm enabling signal comprises an AND circuit, one input terminal of which is connected to a higher frequency stage of said frequency divider means, and another input terminal of which is connected to a lower frequency stage of said frequency divider means for producing a synthesized signal made up of said first and second repetition rates at an output terminal of said AND circuit.

6. A silent electric alarm wrist watch according to claim 5, wherein said means responsive to the respective signals having the first and second repetition rates and the alarm enabling signals includes an additional further AND circuit, one input terminal of which is connected to said output terminal of the first said AND circuit, another input terminal of which is connected to the output terminal of said coincidence circuit for producing a synthesized frequency alarm signal at an output terminal of said second AND circuit.

7. A silent electronic alarm according to claim 1, wherein said said frequency divider means produces, as the signal with the higher repetition rate, a signal having a repetition rate of about 100 Hz.

8. A silent electronic alarm for a wrist watch, said silent alarm comprising an output member adapted to vibrate against a user's wrist, the combination comprising:

(a) generator means for generating a high frequency time standard signal;

(b) frequency divider means responsive to the time standard signal for dividing the high frequency time standard to produce low frequency signals, said frequency divider means including means for producing at least two respective signals having a first repetition rate in the range of from substantially 30 Hz to substantially 300 Hz and a second repetition rate in the range of from substantially 5 Hz to substantially 50 Hz, the first rate being greater than the second rate;

(c) counter means responsive to the output of said divider means for producing a signal representative of the present time;

(d) present time display means responsive to said present time signal produced by said counter means to display the present time;

(e) manually settable means for providing a signal representative of only one selected time at which it is desired to create an alarm signal comprising said vibration of said output member against said user's wrist;

(f) coincidence means, responsive to output signals from said counter means and said manual alarm time settable means, for producing an alarm enabling signal only upon coincidence of the signals representing the present time and the manually set alarm time:

(g) vibration means, including said output member, responsive to the respective signals having the first and the second repetition rates and the alarm enabling signal, for causing said output member to vibrate against a portion of a user's wrist at the first repetition rate and at the second repetition rate intermittently when the alarm enabling signal is present; and (h) said first repetition rate being selected to be substantially the same as the resonant frequency of said output member;

whereby the present time is constantly available in a conventional manner on said said present time display means and the manually set alarm time is silently communicated to the user only upon its occurrence in real time by said vibrating means operating at said first and second repetition rates.

9. The combination of claim 8, wherein said first repetition rate is in the range of at least 100 Hz to less than 300 Hz; and said second repetition rate is in the range of at least 7 Hz to less than 30 Hz.

* * * * *